US006173935B1

(12) United States Patent
Gretz

(10) Patent No.: US 6,173,935 B1
(45) Date of Patent: Jan. 16, 2001

(54) CATHEDRAL CEILING FIXTURE MOUNTING SYSTEM

(75) Inventor: Thomas J. Gretz, Clarks Summit, PA (US)

(73) Assignee: Arlington Industries, Inc., Scranton, PA (US)

( * ) Notice: Under 35 U.S.C. 154(b), the term of this patent shall be extended for 0 days.

(21) Appl. No.: 09/314,835

(22) Filed: May 19, 1999

(51) Int. Cl.[7] ..... B42F 13/00

(52) U.S. Cl. ..... 248/343; 248/342; 52/39; 52/28

(58) Field of Search ..... 248/343, 342, 248/317, 906; 52/28, 39, 27; 362/147, 148, 150, 151, 404

(56) References Cited

U.S. PATENT DOCUMENTS 4,892,211 * 1/1990 Jorgensen ..... 220/3.2
5,234,119 * 8/1993 Jorgensen et al. ..... 272/3.9
5,522,577 * 6/1996 Roesch ..... 248/343
5,592,788 * 1/1997 Corridon ..... 52/39
5,725,190 * 3/1998 Cuthbertson et al. ..... 248/343
5,916,094 * 6/1999 Gretz ..... 52/39
5,939,671 * 8/1999 Gretz ..... 174/50
5,942,726 * 8/1999 Reiker ..... 174/58
5,965,845 * 10/1999 Reiker ..... 174/62
5,981,874 * 11/1999 Reiker ..... 174/63

* cited by examiner

*Primary Examiner*—Anita M. King
*Assistant Examiner*—Naschica Sanders

(57) ABSTRACT

A mounting device for attaching a fan or similar electrical fixture to a cathedral ceiling either at the center of the ceiling or in a pitched section thereof during construction is described. The mounting device comprises; 1) a rectangular box having an open top, a closed bottom, at least two opposing extended side walls and at least one short side wall of about the same depth as; 2) an integral electrical outlet box having a center screw hole, forming a part of the closed bottom and having its open end approximately coplanar with the outer surface of the closed bottom. According to a first embodiment, the extended sidewalls are of a shape to fit the peak of a cathedral ceiling and the mounting device includes two opposing short sidewalls. According to a second embodiment, the mounting device includes, opposing a single short wall, a third extended wall and the two opposing extended side walls that extend angularly from the top of the short wall to the top of the third extended wall so as to generally fit the pitch of a cathedral-type ceiling. A method for installing the mounting device of the present invention is also described.

3 Claims, 6 Drawing Sheets

CATHEDRAL CEILING FIXTURE MOUNTING SYSTEM

FIELD OF THE INVENTION

The present invention relates to devices and methods for mounting ceiling fans and other large and heavy electrical fixtures to cathedral ceilings. More particularly, the present invention describes such a device and method for use principally in new construction.

BACKGROUND OF THE INVENTION

Mounting structures for electrical devices have met increasing demands for strength and stability with the advent and common installation of ceiling fans, particularly lighted such devices, and large chandeliers, especially when such mounting is in a cathedral ceiling or one having a significant pitch. While each of these electrical fixtures or devices has its own unique set of mounting problems, ceiling fans with their large heavy motors and often the addition of lighting devices, have posed a particular issue because of the large static loads which they represent when hung from a ceiling. Additionally, the fan rotation provides a dynamic load that also requires consideration when mounting such devices.

There have been numerous efforts in the prior art to provide adequate structure for the hanging or mounting of large electrical devices that represent large static and/or dynamic loads from cathedral and high-pitch ceilings.

U.S. Pat. No. 4,892,211 To Jorgensen describes a ceiling box for mounting and supporting a ceiling fan on a ceiling. The ceiling box includes a top wall portion with a side wall portion surrounding the periphery of the top wall portion. The box is open at the end opposite the top wall portion and the side wall portion has a pair of flanges extending normal thereto into the open end of the box. These flanges have holes in them for receiving fan-supporting screws. In a first embodiment, a pair of threaded mounting screw holes are formed in the top wall portion and are each axially aligned with an unthreaded hole that extends through the respective flange. In a second embodiment, the holes in the flanges are also threaded for added support.

U.S. Pat. No. 5,183,233 to LaPalomento, describes a support for hanging an electrical fixture from a ceiling or wall and a method for suspending the fixture. The support comprises a panel that is intended to be affixed to the grid work or frame of a house and a support affixed to the panel that holds the electrical fixture. A slot is provided on the rear of the panel to hold the panel flush against a flat surface and to allow electrical wiring to connect to the electrical fixture.

U.S. Pat. No. 5,234,119 to Jorgensen et al, describes a plastic ceiling box adapted to support a ceiling fan and designed to be mounted on a structural member, such as a ceiling joist. The ceiling box comprises a body member having a lower wall and a pair of sidewalls defining a recess for snugly receiving a ceiling joist. Box mounting holes for receiving box mounting fasteners are located at opposite sides and ends of the lower wall for attaching the ceiling box to the joist. Openings for receiving fan supporting fasteners are formed in the body member adjacent the box member and aid in attaching the body member to the joist. This overall arrangement provides sufficient support and strength to resist dynamic loads imposed by the ceiling fan even though the ceiling box is made of plastic.

U.S. Pat. No. 5,522,577 to Roesch describes a mounting assembly for supporting a ceiling fan that includes a support beam located inwardly of the ceiling surface a predetermined distance. An electrical box having a bottom wall is directly joined to and supported from the support beam. The box has sidewalls extending from the bottom wall through the ceiling substantially to the exposed ceiling surface and terminating in an open end. A rigid metal plate or disk member adapted for supporting and mounting a ceiling fan is positioned over the open end of the box. The disk member is of a size sufficient to have a peripheral portion extending radially beyond the side walls of the box and a plurality of mounting screws extend from the metal disk member through the interior of the box into connected engagement with the beam. The mounting screws support the disk member from the beam without reliance on the electrical box for support.

U.S. patent application Ser. No. 08/927,614 entitled "Ceiling Medallion Assembly" filed Sep. 11, 1997 in the name of Thomas J. Gretz describes a mounting assembly for holding an electrical device in place on a joist or stud. The assembly includes an electrical box having a planar base, preferably with three planar surfaces of different depths, a fastener device for temporarily securing an electrical box in place, a ceiling medallion for covering the electrical box, a second fastener device for temporarily securing the ceiling medallion to the electrical box and a fixation device for securely fastening the electrical box and a ceiling bezel to the joist or stud. The electrical box for mounting on the joist or stud includes: a generally rectangular housing with two opposite sides having a stepped appearance defining three different depths of the housing with a third side at a first shallow depth and a fourth side at a third deepest depth, a first back piece spanning the opposing sides at a first depth approximately equal to the thickness of the ceiling material, a second back piece spanning the opposites sides of the second depth that is greater than the first depth of the first back piece, the second depth being approximately equal to twice the thickness of the ceiling material and a third back piece spanning the opposite sides at a third depth that is greater than the second depth of the second back piece.

U.S. Pat. No. 5,592,788 to Corridon issued Jan. 14, 1997 describes a cathedral ceiling fixture mounting system comprising a fixture mount formed as a monolithic member or alternatively, with a bas mount member and one or more pitch mount members stacked sequentially, with each successive pitch mount varying the pitch of the fixture mount such that, when the pitch of the particular cathedral ceiling is known, the fixture mount is modified to correspond to the pitch of the ceiling.

Finally, U.S. Pat. No. 5,503,359 to Patterson, issued Apr. 2, 1996 describes a box assembly for mounting ceiling fans in cathedral or other ceilings with exposed rafters. The device consists of a formed or molded box intended for mounting between exposed rafters that includes mounting facilities for a ceiling fan. The device has provision for electrical wiring to be mounted above the device with the fan being located below the decorative box.

Although the foregoing methods and apparatus have all attempted to solve the problem of adequately mounting the increased loads of electrical fixtures in cathedral or high pitch ceilings; none have provided an entirely adequate solution to this long standing problem.

SUMMARY OF THE INVENTION

According to the present invention, there is provided a mounting device for attaching a fan or similar electrical fixture to a cathedral ceiling either at the center of the ceiling or in a pitched section thereof during construction. The mounting device of the present invention comprises; 1) a rectangular box having an open top a closed bottom, at least two opposing extended side walls and at least one short side wall of about the same depth as; 2) an integral electrical outlet box in the closed bottom and having a center screw hole penetrating the closed bottom and having its open end approximately coplanar with the outer surface of the closed bottom. According to a first embodiment, the extended sidewalls are of a shape to fit the peak of a cathedral ceiling and the mounting device includes two opposing short sidewalls. According to a second embodiment, the mounting device includes, opposing a single short wall, a third extended wall that extends angularly from the top of the short wall to the top of the third extended wall so as to generally fit the pitch of a cathedral-type ceiling. A method for installing the mounting device of the present invention is also described.

DETAILED DESCRIPTION OF THE INVENTION

Figure 1:
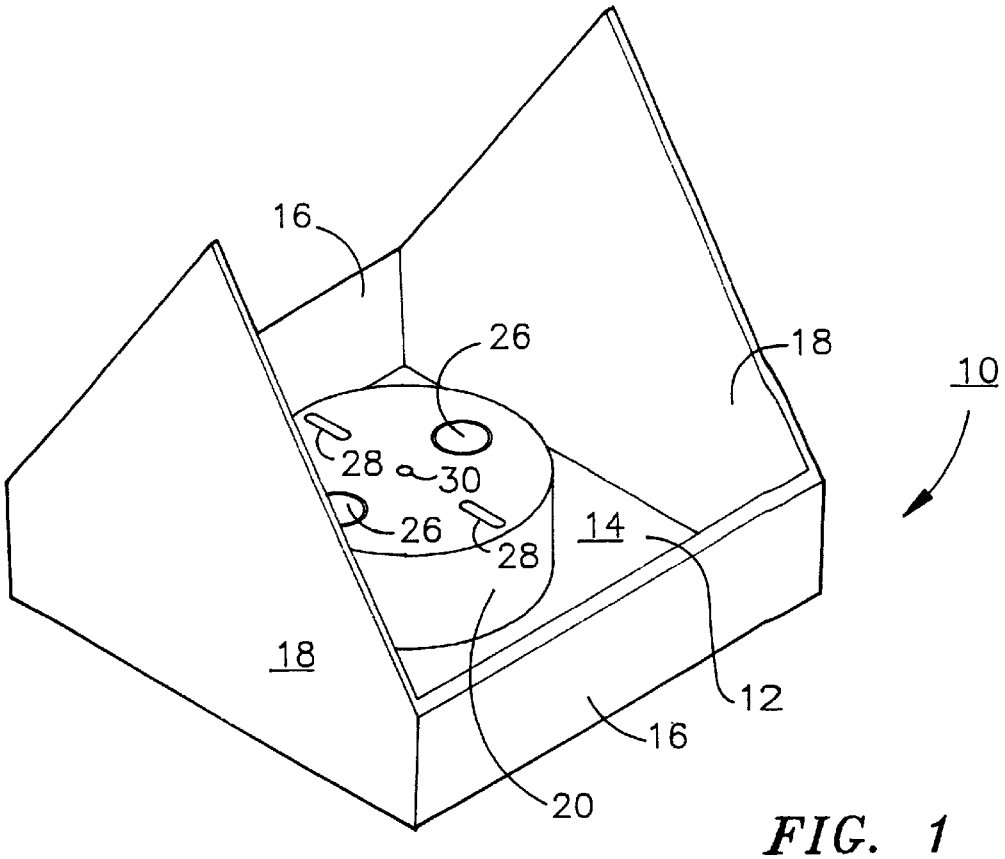
FIG. 1 is a perspective view of one embodiment of the mounting device of the present invention.
Figure 2:
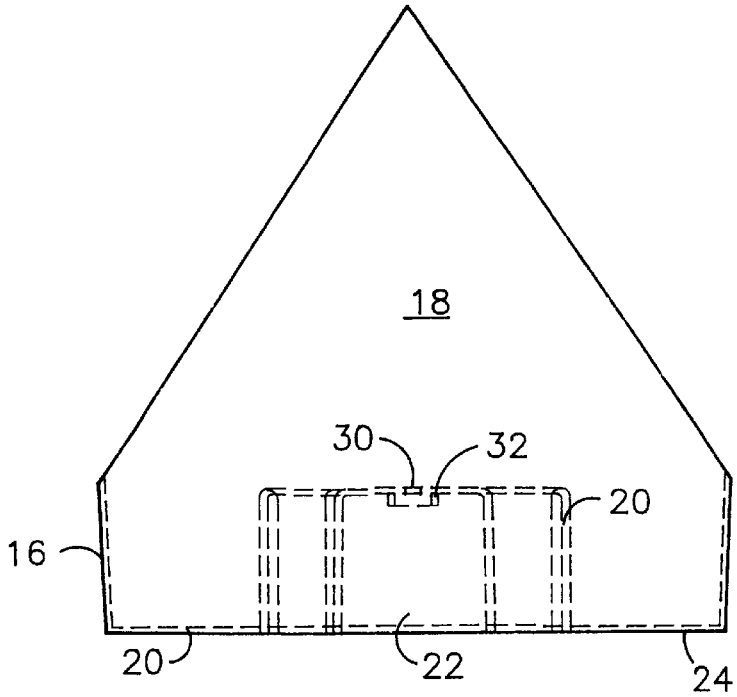
FIG. 2 is a side view of the mounting device depicted in FIG. 1.
Figure 3:
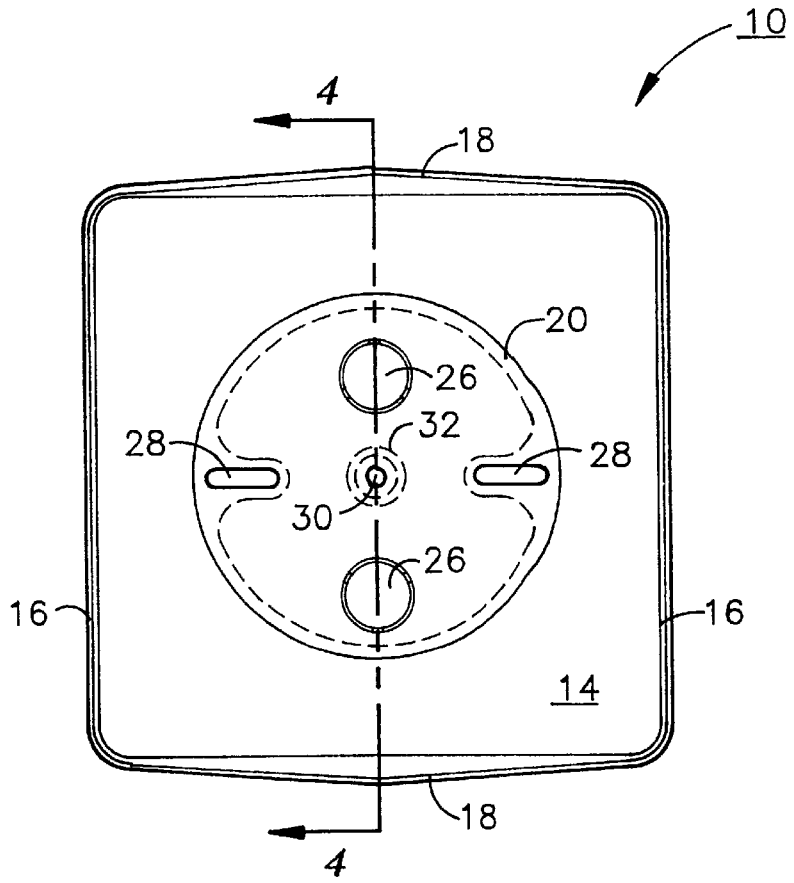
FIG. 3 is a side view of the mounting device depicted in FIG. 1.
Figure 4:
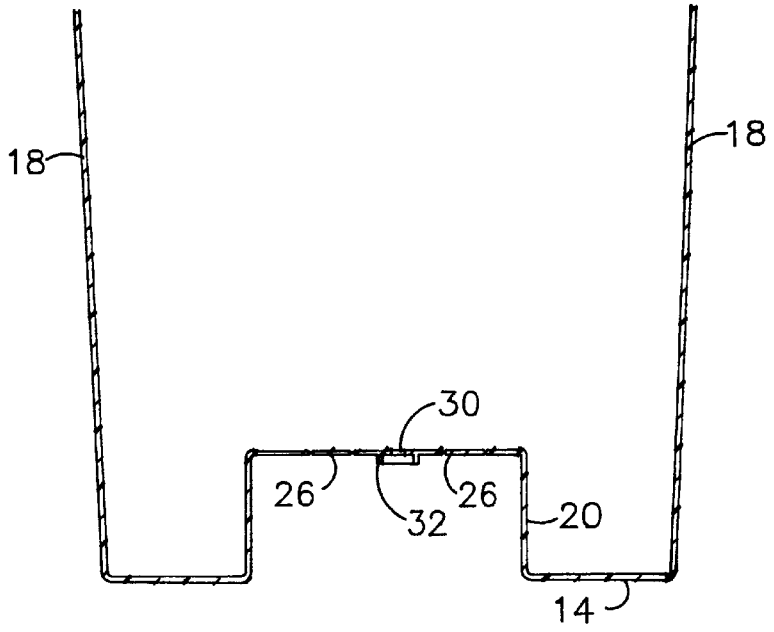
FIG. 4 is a cross-sectional view of the mounting device depicted in FIG. 1.
Figure 5:
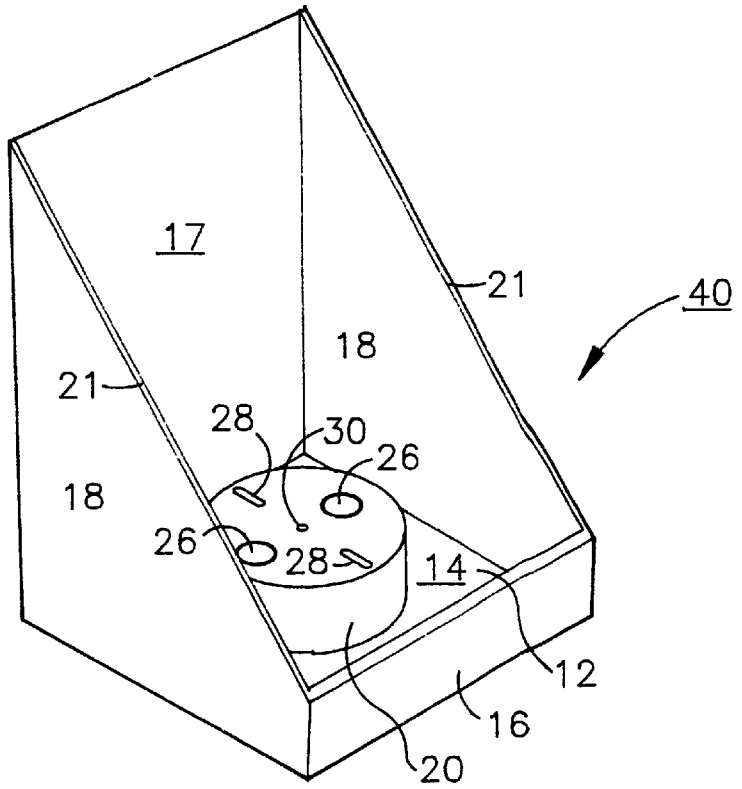
FIG. 5 is a perspective view of a second embodiment of the mounting device of the present invention.
Figure 6:
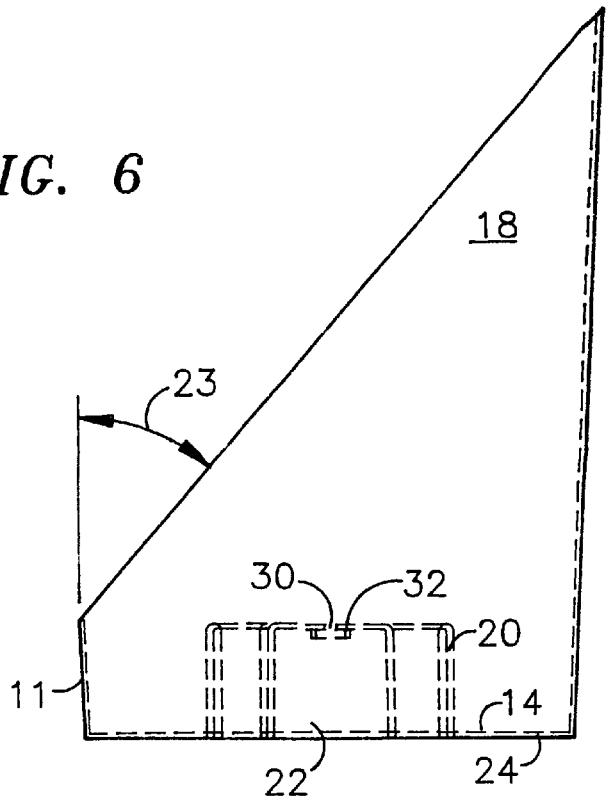
FIG. 6 is a side view of the mounting device depicted in FIG. 5.
Figure 7:
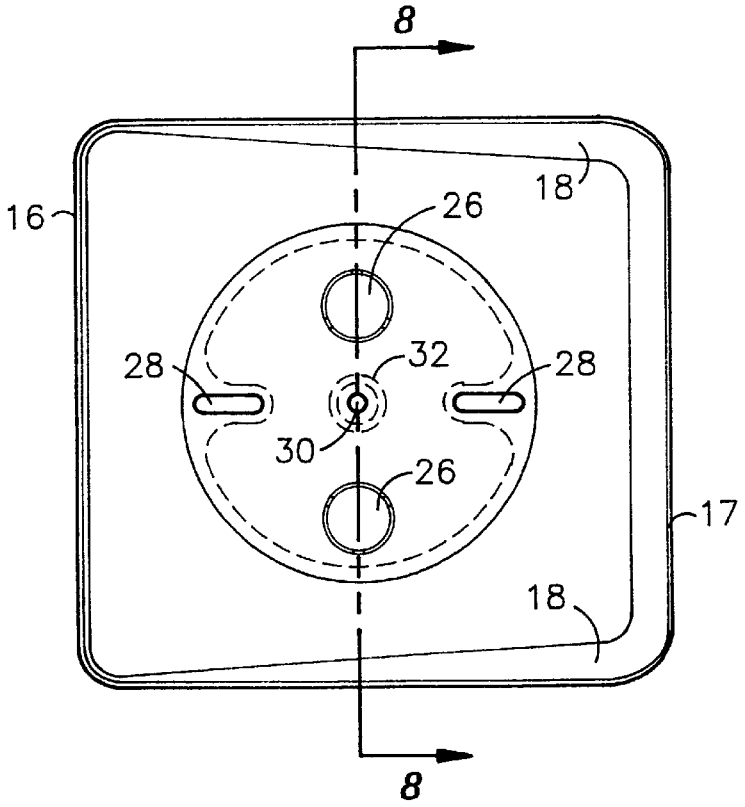
FIG. 7 is a top view of the mounting device depicted in FIG. 5.
Figure 8:
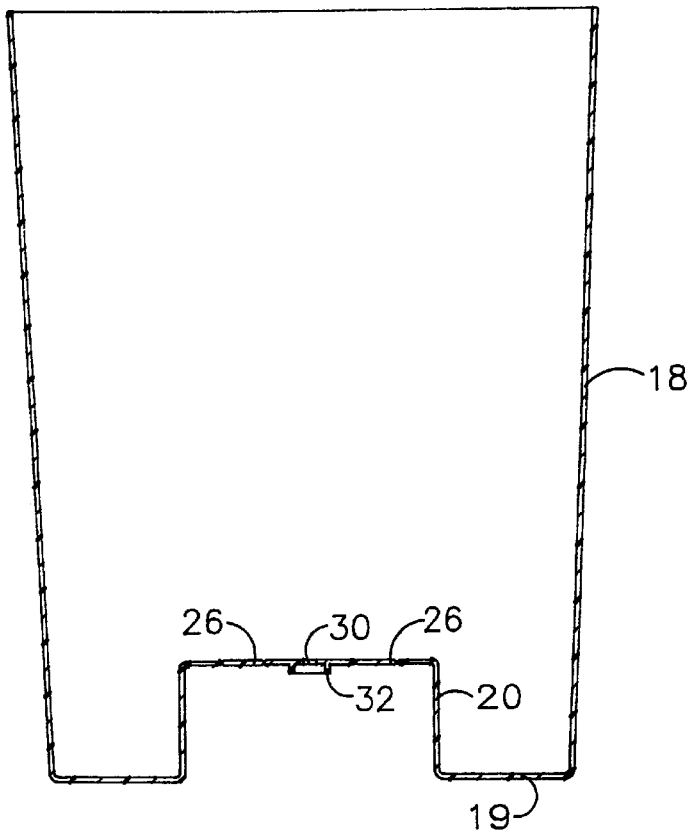
FIG. 8 is a cross-sectional view of the mounting device depicted in FIG. 5.
Figure 9:
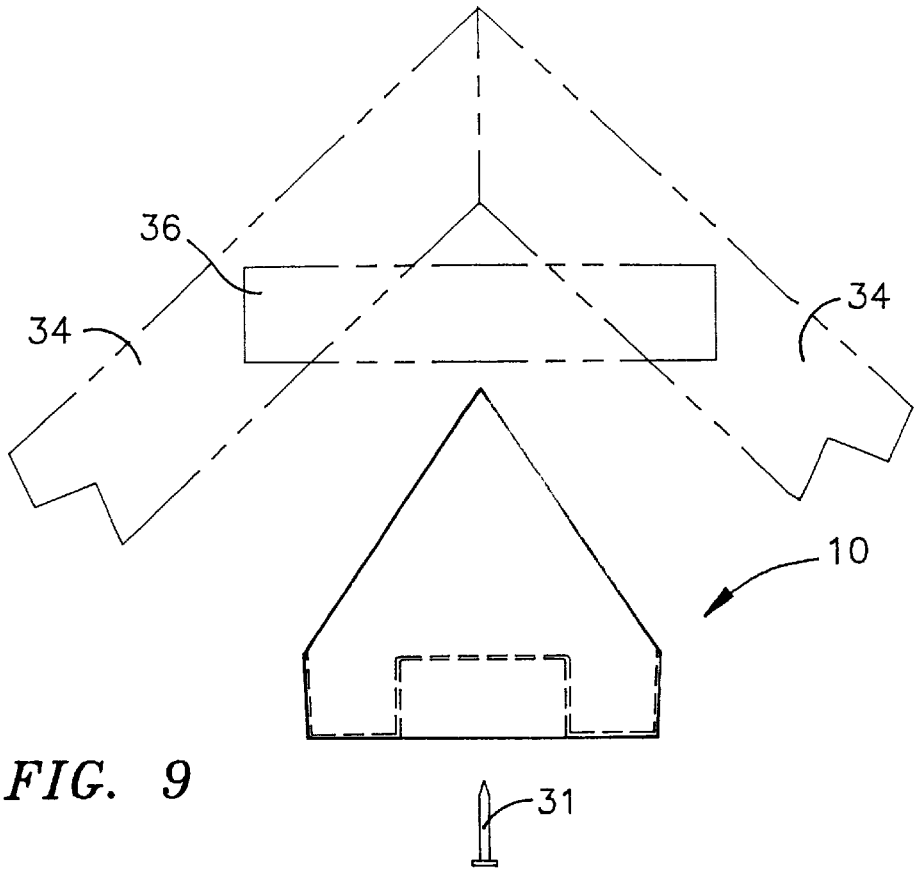
FIG. 9 is a blown-a-part drawing showing the method of installation of the mounting device depicted in FIG. 1.
Figure 11:
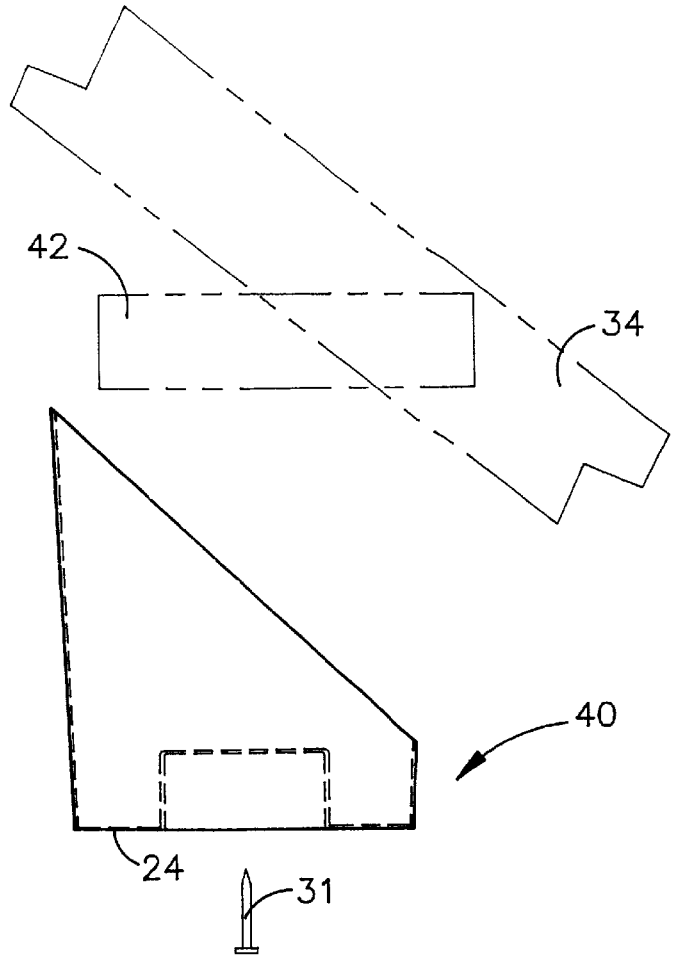
FIG. 11 is a blown-a-part drawing showing the method of installation of the mounting device of FIG. 5.

As shown in FIG. 1, the first embodiment of the mounting device 10 of the present invention comprises a generally rectangular box 12 having a closed bottom 14, a pair of opposing short walls 16, a pair of opposing extended walls 18 and a electrical box 20 that is integral with bottom 14 and whose open end 22 in surface 24 is approximately coplanar with surface 24. This is seen most clearly in FIG. 2. Electrical box 20 is conventionally formed and includes the usual knockouts 26 to provide access to its interior for cable or wiring as well as slots 28 for insertion of bolts to secure a subsequently installed fan or other electrical fixture. Additionally, electrical box 20 includes a central hole 30 for insertion of a screw 31 as will be described hereinafter. Central hole 30, as best shown in FIG. 2, includes about its inside periphery, an annular ring 32 of a size to receive a subsequently installed screw 31. Annular ring 32 serves to retain screw 31 in a centered position as well as serving as a guide when screw 31 is installed as shown in FIGS. 9 and 11 described below. Annular ring 32 also serves to reinforce the area of highest force concentration about screw hole 30 when a fixture such as a fan is installed as described below.

Opposing short walls 16 are of about the same height as the depth electrical box 20.

Opposing extended side walls 18 may be of any suitable height as long as they are of sufficient height as to provide coverage of any gaps between a subsequently installed ceiling of drywall or other material as described hereinafter. Their shape is generally that of the center or peak of a cathedral ceiling to provide adequate such coverage.

Figure 10:
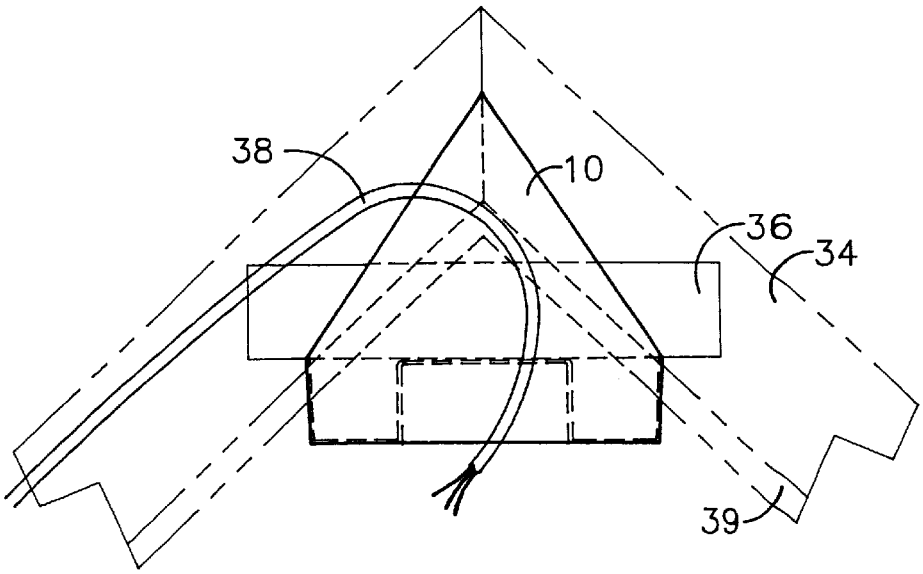
FIG. 10 is a side view showing the mounting device of FIG. 1 in its installed position.

Installation of mounting device 10 is shown in FIG. 9. To preexisting ceiling rafters 34 is nailed or otherwise attached an adequate piece of wood 36, for example a common 2×4 or other material suitable for receipt and securing of a screw. Device 10 is then inserted over wood 36 with extended sidewalls 18 on either side thereof, i.e. straddling wood 36. Screw 31 is then inserted through hole 30 and secured to wood 36 and mounting device 10 thereby centered and tightly secured to wood 36. Wires 38 are then run to device 10 and through knockouts 26. Drywall 39 or other suitable ceiling finishing material is then installed in the conventional fashion over rafters 34 and brought to the outer edge of mounting device 10 and appropriately finished as shown in FIG. 10. A fan or other electrical fixture (not shown) may then be installed at a later time by insertion of its mounting hardware (not shown) into slots 28 of electrical box 20 in the conventional fashion. The term "rafter" or "rafters" as used herein is not intended to be in any way limiting, it being the intent of the inventor to include any angular structural member to which the mounting device of the present invention may attached as described herein.

A second embodiment 40 of the mounting device of the present invention designed for the installation of electrical fixtures on the surface of a ceiling, such as one side of a cathedral ceiling, that is pitched from horizontal is shown in FIGS. 5–8. This device shares most elements with the embodiment depicted in FIGS. 1–4 except for the difference in the shape of the opposing side walls 18 and the presence of only a single short wall 16.

A shown in FIGS. 5–8, this second embodiment of mounting device 40 of the present invention includes a generally rectangular box 12 having a bottom 14 and a single short wall 16. An extended wall 17 replaces the other opposing short wall 16 previously described in connection with FIGS. 1–4 for reasons that will be apparent from the description that follows. Electrical box 20 again includes knockouts 26, slots 28 and center hole 30 whose locations and functions are identical to those previously described. Side walls 18, in lieu of being peaked to fit the center or peak of a cathedral ceiling, as shown in FIGS. 1–4, are angular, rising from the top of short wall 16 to the top of extended wall 17. Again the reasons for this design will be apparent in connection with the installation method and use hereinafter described.

Figure 12:
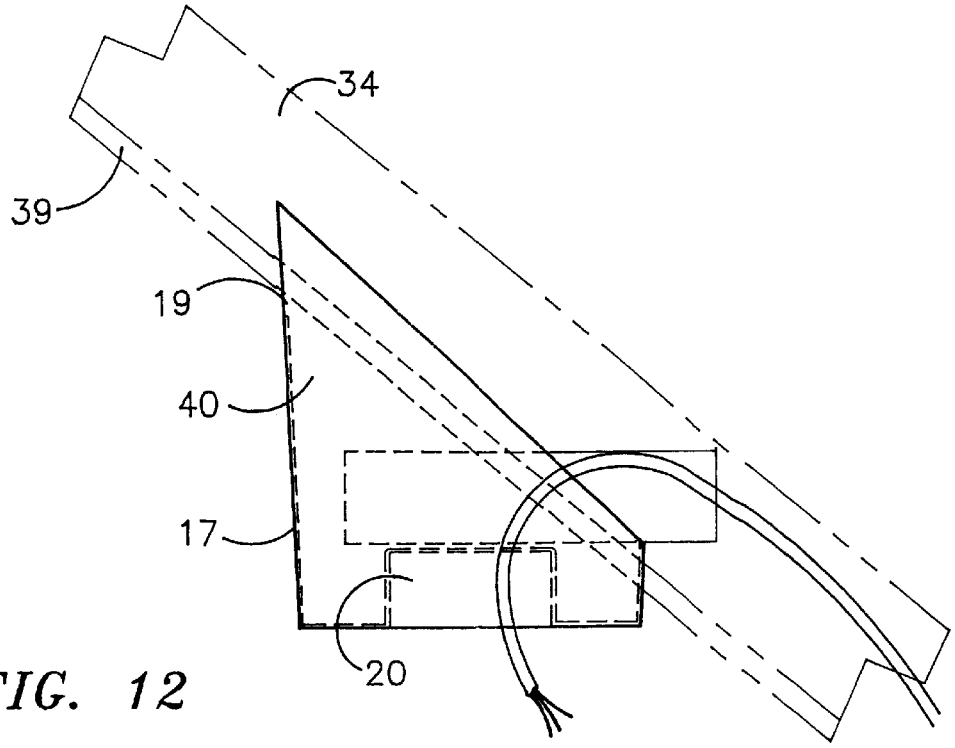
FIG. 12 is a side view showing the mounting device of FIG. 5 in its installed position.

Installation of mounting device 40 is accomplished by attachment through nailing or otherwise of an appropriately cut piece of 2×4 or 2×6 42, or other suitable material, to a preexisting rafter 34 such that a portion thereof extends beyond the outer surface of rafter 34 as shown in FIG. 11. Mounting device 40 is then applied over, piece 42 such that walls 18 straddle piece 42 and screw 31 inserted through center hole 30 and screwed securely into piece 42. In this fashion, mounting device 40 is firmly and securely attached to piece 42 and consequently rafter 34. Depending upon the particular pitch of rafter 34, it may be necessary to notch wall 17 of mounting device 40, as shown at 19 in FIG. 12, such that it fits snuggly against rafter 34 when outer surface 24 is leveled. The particular extension angle of side walls 18 in this embodiment is not particularly critical so long as the long edges 21 are of sufficient length as to form an acceptable joint with the abutting ceiling material as described below. An extension angle 23 of about 45° has been found acceptable for most installations. Appropriate wiring 38 is then inserted through knockout 26 as shown in FIG. 12. The mounting device is then ready for the subsequent installation of an electrical fixture (not shown) through insertion of the fixture mounting bolts (not shown) through slots 28 as is conventionally done. Drywall 39 or other is then applied over rafter 34 in the conventional manner and the joint between the drywall and mounting device 40 finished.

Mounting devices 10 and 40 can be fabricated from any suitable material and in any number of fashions, however, it is preferred that they be monolithic plastic structures such as those made by injection molding for reasons of cost, convenience, safety, i.e. insulation, and ease of manufacture.

From the foregoing description, one skilled in the art can easily ascertain the essential characteristics of this invention, and without departing from the spirit and scope thereof, make various changes and modifications of the invention to adapt it to various usages and conditions. It is therefor intended that the scope of the invention be limited only by the scope of the appended claims.

What is claimed is:

1. A mounting device for attaching an electrical fixture to a cathedral ceiling having at least one rafter comprising:

a) a rectangular box comprising:
  i) an open top;
  ii) a closed bottom having an outer surface;
  iii) at least two opposing extended walls;
  iv) at least one short wall having a top edge; and
  v) a third extended wall opposite said short wall and having a top edge, and further wherein said at least extended walls extend angularly from said top edge of said short wall to said top edge of said third extended wall so as to roughly parallel said rafter, said short wall being of about the same depth as;
  ii) an integral electrical outlet box forming part of the closed bottom, having an open end approximately coplanar with said outer surface, and including a center screw hole, said opposing extended walls being of a shape to fit said cathedral ceiling.

2. A method for providing an electrical fixture mounting device on a cathedral ceiling or the like having at least one rafter comprising:

a) horizontally attaching a piece of material suitable for receipt of a screw to said at least one said rafter;
b) placing said mounting device comprising:
  i) a rectangular box comprising:
    A) an open top;
    B) a closed bottom having an outer surface;
    C) at least two opposing extended walls; and
    D) at least one short wall having a top edge; and
    E) a third extended wall opposite said short wall and having a top edge, and further wherein said at least extended walls extend angularly from said top edge of said short wall to said top edge of said third extended wall so as to roughly parallel said rafter, said short wall being of about the same depth as;
  ii) an integral electrical outlet box forming part of the closed bottom, having an open end approximately coplanar with said outer surface, and including a center screw hole, said opposing extended walls being of a shape to fit said cathedral ceiling, over said piece of material such that said extended opposing side walls straddle said piece of material;
c) inserting of a screw through said center screw hole; and
d) tightening of said screw while said opposing extended walls straddle said piece of material.

3. The method of claim 2 wherein said piece of material is attached to a single rafter and extends therefrom generally in a horizontal direction.

* * * * *